United States Patent [19]

Morrison et al.

[11] Patent Number: 4,690,193

[45] Date of Patent: Sep. 1, 1987

[54] ROLLING SHUTTER CONSTRUCTION

[75] Inventors: Donald L. Morrison, Huntington Beach; Stephen Bartok, Rancho Palos Verdes, both of Calif.

[73] Assignee: The Standard Oil Company, Cleveland, Ohio

[21] Appl. No.: 763,453

[22] Filed: Aug. 7, 1985

[51] Int. Cl.[4] ..... E06B 9/16

[52] U.S. Cl. ..... 160/133; 160/232; 160/235; 160/236

[58] Field of Search ..... 160/133, 232, 233, 234, 160/235, 236

[56] References Cited

U.S. PATENT DOCUMENTS

| | | | |
|---|---|---|---|
| 769,423 | 9/1904 | Wilson | 160/232 |
| 1,014,611 | 1/1912 | Rush | 160/235 |
| 1,017,808 | 2/1912 | Rush | 160/235 |
| 1,936,300 | 11/1933 | Guss | 189/46 |
| 2,872,977 | 2/1959 | Pagliaccetti et al. | 160/220 |
| 2,926,729 | 3/1960 | Zanini | 160/236 |
| 3,454,073 | 7/1969 | Man | 160/133 X |
| 3,642,050 | 2/1972 | Piana | 160/133 |
| 3,970,134 | 7/1976 | Sinnock et al. | 160/133 |
| 3,989,084 | 11/1976 | Inamura et al. | 160/36 |
| 4,037,639 | 7/1977 | Jones | 160/33 |
| 4,173,247 | 11/1979 | Piana | 160/236 |
| 4,197,896 | 4/1980 | Reichstadt | 160/107 |
| 4,343,340 | 8/1982 | Paule | 160/232 |
| 4,345,635 | 8/1982 | Solomon | 160/133 |
| 4,436,136 | 3/1984 | Downey | 160/232 |

FOREIGN PATENT DOCUMENTS

| | | | |
|---|---|---|---|
| 2559076 | 7/1977 | Fed. Rep. of Germany | 160/133 |
| 2322254 | 2/1977 | France | 160/236 |
| 2479891 | 10/1981 | France | 160/236 |
| 624494 | 9/1961 | Italy | 160/133 |

OTHER PUBLICATIONS

Pease brochure entitled "Exterior Rolling Shutters".
Pease Architectural-Spec Sheet.
European Energy Savers brochure entitled "Heroal GK System".
European Energy Savers brochure entitled "Exterior Rolling Shutters".
Brochure entitled "Solaroll Shade and Shutter Corporation".
One sheet advertisement entitled "Wiral".
Brochure entitled "Pro-Tec-To Rolling Shutters".
Brochure entitled "Rolladen Rolling Shutters".
Brochure entitled "Rollawn—The Energy Saving Security Shutter".
Brochure entitled "Roll-A-Way Insulating Security Shutters".

*Primary Examiner*—Ramon S. Britts
*Assistant Examiner*—David M. Purol
*Attorney, Agent, or Firm*—Renner, Otto, Boisselle & Lyon

[57] ABSTRACT

A rolling shutter characterized by an array of edge-adjacent, parallel shutter slats and full shutter width, clear shutter segments or links articulately interconnecting respective pairs of adjacent shutter slats. The links are telescopically movable in the slats to permit relative movement of the slats between spaced-apart and juxtaposed positions. When spaced apart, the slats form therebetween a gap which exposes the clear link which permits passage of light over substantially the full extent of the gap. The clear links also provide a double hinge-like joint between adjacent slats. The shutter slats are also uniquely reinforced and have an improved exterior appearance.

23 Claims, 9 Drawing Figures

ROLLING SHUTTER CONSTRUCTION

The invention herein described relates generally to rolling shutters and, more particularly, to the construction and reinforcement of rolling shutters.

BACKGROUND

Rolling shutters typically include an array of horizontal slats which are articulated or linked such that the shutter can be rolled or wound onto a storage roller. The storage roller usually is contained within a housing that may be mounted above a window or door opening in a building. In use, the storage roller is rotated by a drive mechanism in opposite directions to roll and unroll the shutter thereby to raise and lower the shutter, respectively. As the shutter is lowered, opposite ends of the lowered slats are received and guided in side rails secured exteriorly to the building at respective sides of the opening to be opened and closed by the shutter. The guide rails usually are linear and retain the lowered shutter slats in generally coplanar relation parallel to the plane of the opening.

Known rolling shutters have provided with varying degrees of success one or more benefits including security against break-in, energy savings, protection against high winds, light control and noise abatement. On the other hand, known rolling shutters have had associated therewith one or more drawbacks including low aesthetic appeal, high cost and availability in only standard sizes or by special order.

One type of rolling shutter is characterized by extruded opaque plastic slats having hollow bodies of generally rectangular shape. Along the top edges of their bodies, the slats have upwardly projecting hook-like tongue members which hingedly interlock in channels formed in the lower edge portions of the slat bodies. The downwardly opening channels are partly closed to prevent pull-out of the tongue members while of sufficient depth to permit substantially full telescopic movement of the tongue members into the channels. By reason of such telescopic movement, the bodies of adjacent slats can be brought into edge-to-edge abutment for full closure of the shutter or slightly spaced apart to allow adjacent slats to pivot relatively for winding onto the storage roller.

When spaced apart as when suspended in front of the building opening, the bodies of adjacent slats would form a gap therebetween which would expose a stem portion of the hook-like tongue member. A common practice has been to punch a row of small and horizontally spaced apart slots into the stem portion to enable the passage of light and air between the relatively suspended slat bodies. The slots, however, weakened the hinge-like joint between adjacent slats, and the punching operation added to the cost of shutter manufacture. Also, the amount of light passed between the slat bodies was limited as was visual observation ability. Respecting the latter limitation, it was difficult if not impossible for a person standing a couple of feet inside the shutter to recognize through the shutter a person standing outside the shutter because of the limited view afforded by the small and horizontally spaced slots.

Known rolling shutters also have been provided with bending reinforcement in order to resist, for example, hurricane force winds. The bending moments caused in the slats by high winds usually are greatest at the middle of the side rail-supported rolling shutter and one approach to reinforcement has been to install a vertical bar as a center support for the rolling shutter. Another approach has been to insert strengthening rods inside hollow shutter slats, but known strengthening rods and their method of use have had associated therewith one or more drawbacks. For example, prior metal strengthening rods have had to be cut as by sawing if the length of the slats required adjustment to fit a particular width of a window. Such strengthening rods also added considerable weight to the rolling shutter. One known reinforcement was a metal rod having a back-to-back E-shape cross section. The rod was designed to frictionally fit into an intermediate cell formed by interior walls of the slat body.

Another undesirable feature of known rolling shutters has been the appearance of horizontal bands when sunlight is reflected off the outside surface of the rolling shutter. This banding effect gave the appearance that the buidling opening had horizontal bars extending thereacross which was not particularly attractive or aesthetically pleasing.

SUMMARY OF THE INVENTION

The present invention provides an improved rolling shutter wherein the slats are uniquely articulated and which provides, when not fully closed, better light transmission and/or ventilation in an aesthetically pleasing manner. More particularly, the rolling shutter admits about eight times more light than conventional shutters with punched slots, eliminates the extra manufacturing step to punch the slots, and affords superior visual observation ability through the shutter yet complete privacy when fully closed. The invention also provides a unique reinforcement for the shutter slats which may be easily length adjusted without cutting and which has an advantageous strength to weight characteristic. The invention also provides an improved exterior appearance of the shutter which is not subject to the above noted banding effect.

According to one aspect of the invention, a rolling shutter comprises at least two edge adjacent, parallel and opaque shutter slat bodies, and connecting means for articulately interconnecting the slat bodies while permitting relative edge-wise movement of the slat bodies between juxtaposed positions and spaced apart positions. The slat bodies when spaced apart form a gap therebetween which exposes a portion of the connecting means, and the exposed portion of the connecting means is made of a translucent material permitting passage of light through the gap. More particularly, relatively adjacent shutter slats are articulately interconnected by respective full shutter width, clear links which telescope into the adjacent slats to permit edge abutment of the opaque slats for privacy when the shutter is fully closed.

According to another aspect of the invention, a rolling shutter comprises an array of edge-adjacent, parallel shutter slats each formed at each edge with an edge channel. A plurality of connecting links articulately interconnect respective pairs of adjacent shutter slats. Each link has opposite edge portions respectively retained in adjacent edge channels respectively of the adjacent shutter slats for pivotal movement to permit pivoting of the link relative to both the adjacent slats and for edge-wise telescoping movement to permit relative movement of the adjacent slats between spaced-apart and juxtaposed positions. Each link generally is C-shape in cross-section with opposite edge portions curved to form hooks for interconnecting with locking members at the edges of the shutter slats.

According to another aspect of the invention, a rolling shutter slat comprises a slat body including at least one channel extending along the length thereof, and a pair of telescopically connected reinforcing members received in and extending substantially the length of the channel. A rolling shutter slat, according to the invention, may also comprise a hollow body having opaque inside and outside walls joined together by transverse walls, and the outside wall having an edge-to-edge unbroken curved outer surface. As utilized herein, an unbroken curved surface is one which is continuously concave or convex over the total area of the surface.

Further features and details of the present invention hereinafter are more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
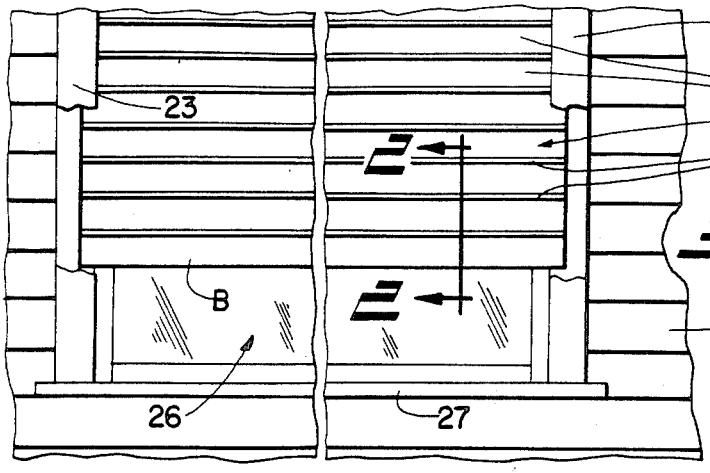
FIG. 1 is a fragmentary front elevational view of a rolling shutter according to the subject invention, the rolling shutter being shown in a partly lowered position.

In FIG. 1, a rolling shutter according to the subject invention is indicated generally at 20 and can be seen to comprise an array of parallel shutter slats 21 which are articulately interconnected by connecting links 22. The rolling shutter 20 may be used in conventional manner, i.e., the uppermost shutter slat may be connected, for example, to a storage roller that is rotated in opposite directions to roll and unroll the shutter between shutter open and shutter closed positions. As the shutter slats are fed from the storage roller, opposite ends thereof may be received and guided in respective guide rails 23 and 24 usually secured exteriorly to the side wall 25 of a building at respective sides of an opening 26 in the building side wall to be opened and closed by raising and lowering of the rolling shutter. The guide rails 23 and 24 usually are linear and serve to hold the shutter slats 21 in generally coplanar relation parallel to the plane of the building opening 26. As shown, the side rails 23 and 24 extend vertically upwardly from a sill 27 against which the rolling shutter may be lowered.

In the illustrated preferred embodiment and best mode, the shutter slats 21 and connecting links 22 are plastic extrusions cut or otherwise formed in substantially equal lengths corresponding to the width of the shutter 20. Also, the connecting links are identical in cross-section as are the shutter slats except for the bottommost shutter slat identified by reference letter B. Accordingly, the description of any one slat 21 or connecting link 22 is equally applicable to each other slat or connecting link, respectively. For reasons discussed below, the shutter slats preferably are made of opaque plastic material whereas the connecting links are made of translucent and preferably clear transparent plastic material.

Figure 2:
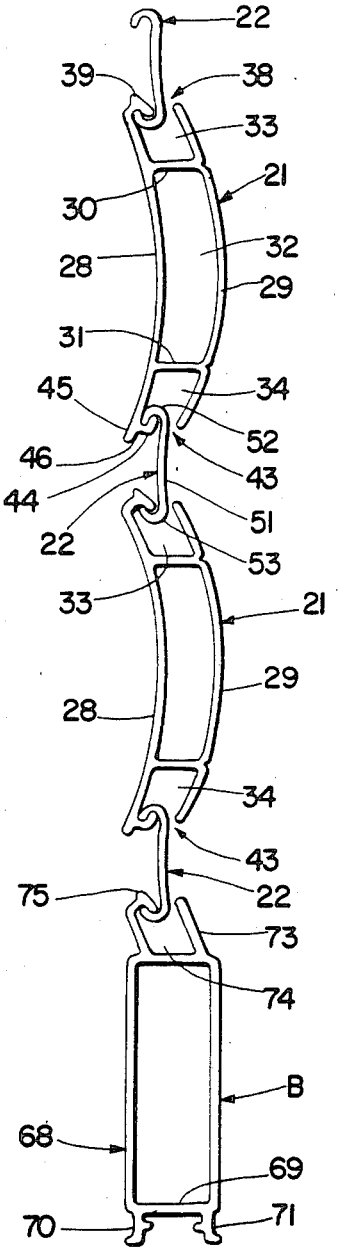
FIG. 2 is an enlarged vertical section through the rolling shutter taken substantially along the line 2—2 of FIG. 1 showing the shutter slats in their spaced apart/open condition.

As seen in FIG. 2, each slat 21 is in the form of a hollow body having a generally rectangular, slightly bowed cross-sectional shape. The slat has a concave outer side wall 28 and a convex inner side wall 29 extending generally parallel to the outer side wall. The outer and inner side walls, which are approximately equal in thickness and vertical height, are joined together by integral, transversely extending upper and lower partition walls 30 and 31. The partition walls 30 and 31 are parallel and vertically spaced apart to form therebetween, along with central portions of the outer and inner side walls, a central channel 32 which is closed except at the ends of the slat. In addition to being vertically spaced apart, the partition walls 30 and 31 are vertically inwardly spaced from the top and bottom edges of the slat to form, along with respective edge portions of the outer and inner side walls, upper and lower channels 33 and 34.

The upper channel 33 is open at a slot 38 to the top edge of the slat 21, such slot 38 extending the length of the slat and having a transverse dimension less than that of the channel 33. The slot 38 is formed between the upper horizontal edge of the inner side wall 29 and an upper locking member 39. The upper locking member 39 is integral with and projects transversely inwardly from the upper horizontal edge of the outer side wall 28. The upper locking member generally has an inverted V-shape with an included angle of about 90°.

In a similar but opposite manner, the lower channel 34 is open at a slot 43 to the bottom edge of the slat 21. The slot 43 is formed between the lower horizontal edge of the inner side wall 29 and a lower locking member 44. The lower locking member is generally V-shape in cross-section and projects inwardly from the outer side wall 28 near the lower horizontal edge of the outer side wall. The outer side wall preferably projects downwardly beyond the point of attachment of the lower locking member to form a lip 45 which defines with the relatively adjacent leg of the lower locking member a shallow inverted V-shape groove 46.

Turning now to the connecting link 22, such can be seen in FIG. 2 to have a central narrow panel-like web portion 51 and upper and lower curved edge portions 52 and 53. The curved edge portions 52 and 53 are reversely turned upon themselves and both outwardly from the web portion 51 to form respective J-shape hooks with the web portion serving as a common stem of the hooks. The web portion is generally planar and preferably slightly bowed with its concave surface facing outwardly. The link also preferably is of relatively uniform thickness throughout the integral, single-walled web and curved edge portions.

Figure 4:
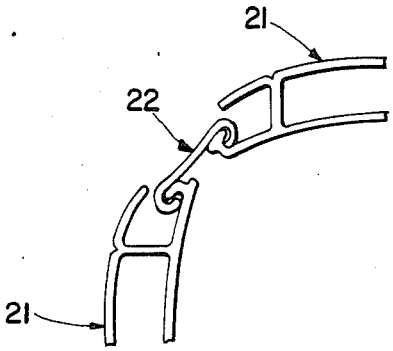
FIG. 4 is a fragmentary vertical section through two relatively adjacent slats which have been relatively pivoted as would be the case when rolled onto a storage roller.

The upper curved edge portion or hook 52 of the link 22 is received in the lower channel 34 of the upwardly adjacent slat, the lower curved edge portion or hook 53 of the link is received in the upper channel 33 of the downwardly adjacent slat, and the web portion 51 passes through the upper and lower edge slots 38 and 43. The upper and lower hook-like edge portions 52 and 53 of the link vertically interfere respectively with the lower and upper locking members 44 and 39 of the adjacent slats to retain the hook-like edge portions of the link in the slat channels thereby to connect the link to and between the adjacent slats. The hook-like edge portions and channels also are relatively sized to permit turning movement of the hook-like edge portions of the link in the channels of the slats about horizontal axes thereby to permit relative pivotal or hinge-like movement between the link 22 and each adjacent slat 21. In this manner, a double hinge-like connection or joint is effected between the relatively adjacent slats which facilitates compact roll-up of the shutter on a storage roller. As seen in FIG. 4, the slats can be relatively pivoted to form therebetween an included angle of about 90° without inducing any stress in the link or slats. To effect assembly of the shutter, the hook-like edge portions of one connecting link may be end-wise inserted into the channels of the adjacent slats.

Figure 3:
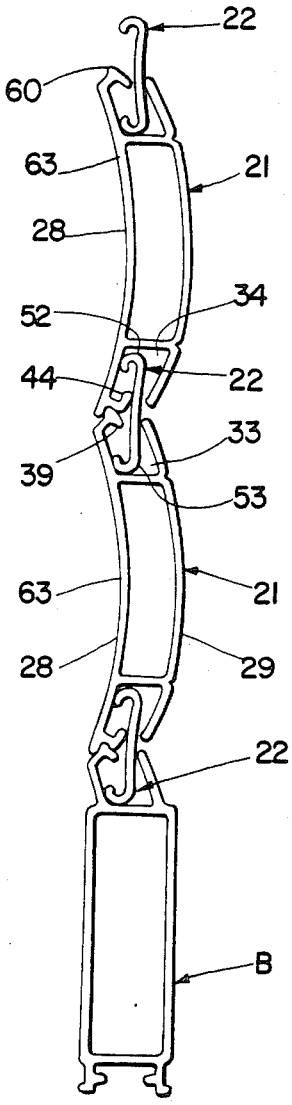
FIG. 3 is a vertical section similar to that of FIG. 2 but showing the shutter slats in their juxtaposed/closed condition.

The slat channels 33 and 34 and the hook-like edge portions 52 and 53 of the links 22 also are relatively sized to permit vertical edge-wise telescoping movement of the hook-like edge portions in the slat channels as can be seen by comparing FIGS. 2 and 3. When the link is in a state of tension between two adjacent slats the upper hook-like edge portion 52 of the link 22 will be supported atop the lower locking member 44 of the upwardly adjacent slat and the upper locking member 39 of the downwardly adjacent slat will be supported atop the lower hook-like edge portion 53 of the link as seen in FIG. 2. As a result of this, the slats will be vertically spaced apart to form a narrow horizontally extending gap 58 therebetween through which the web portion 51 of the connecting link is open to view as seen in FIG. 5.

Figure 5:
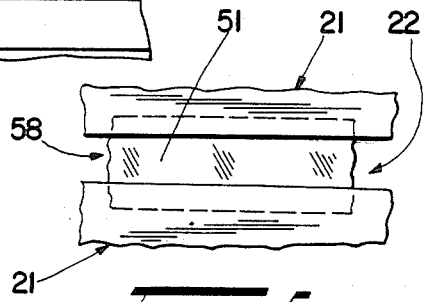
FIG. 5 is a fragmentary front elevational view looking in the direction of line 5—5 of FIG. 2.
Figure 6:
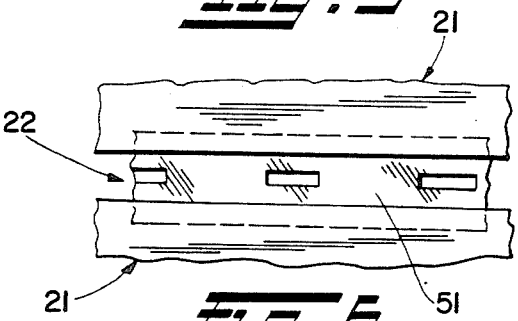
FIG. 6 is a view similar to FIG. 5 but illustrating optional ventilation slots in the link interconnecting adjacent slats.

As above indicated, the connecting link 22 preferably is translucent and most preferably is transparent for clear viewing through the web portion 51 of the link that is exposed at the gap 58 when the adjacent slats are relatively spaced apart as seen in FIGS. 2 and 5. This permits a substantial amount of light to enter from outside to inside the room across the full width of the rolling shutter while still providing a strong full length hinge-like joint between adjacent slats. Also, the widthwise continuous transparent or translucent areas between opaque slats is very aesthetically pleasing. If desired, a horizontal row of spaced apart slots 59 may be provided in the web portion 51 for ventilation purposes as seen in FIG. 6.

At the opposite end of the range of movement between adjacent slats 21, as occurs when the rolling shutter 20 is forced downwardly against the sill 25 (FIG. 1), the slats will be in edge-to-edge abutment as seen in FIG. 3. The connecting link 22 will be telescoped fully into the channels 33 and 34 of the adjacent links with approximately the lower half of the link received in the upper channel 33 of the downwardly adjacent slat and approximately the upper half of the link received in the lower channel 33 of the upwardly adjacent slat. As further seen in FIG. 3, a small bead 60 projecting upwardly and outwardly from the vertex of the upper locking member 39 nests in the vertex of the mating V-shape groove 46 extending along the lower edge of the upwardly adjacent slat. The resultant closed mated seam between the adjacent slats serves as a weather barrier stop to prevent water and wind from passing between the slats. The connecting link also enhances the barrier to wind striking the outside of the rolling shutter since any wind passing through the closed mated seam would have to pass along a tortuous path to reach the inside of the rolling shutter.

When the shutter slats 21 are fully closed together as seen in FIG. 3, the hook-like edge portions 52 and 53 of the connecting link 22 will have been moved in the slat channels 33 and 34 vertically away from the locking members 39 and 44. However, the edges of the inner side wall 29 will ensure that upon relative separating movement of the slats that the hook-like edge portions of the link will properly interlock with the locking members. That is, the upper and lower edges of the inner side wall bearing against the inside surface of the bowed web portion 51 of the link will cause the hook-like edge portions of the link to slide along the interior surface of the outwardly bowed edge portions of the outer side wall 28 and into locking engagement with the locking members as the shutters move relatively apart.

As seen in FIG. 3, the outer side wall 28 of each slat 21 has a full height, unbroken curved outer surface 63 which preferably is smooth and continuously concave over the full height of the slat. Accordingly, the overall outer surface of the rolling shutter when fully closed consists of an array of horizontally extending slightly concave surfaces 63 and a small horizontally extending, thin line seam between relatively adjacent concave surfaces. It has been found that such overall outer surface is not subject to the drawbacks associated with prior art shutters wherein when sunlight strikes the shutter, the reflected light, particularly from flat surfaces relative to curved surfaces, gives rise to the appearance of horizontal bands or bars extending across the width of the shutter. This banding effect is not aesthetically pleasing. By providing the shutter slats with a continuously smooth and concave surface as herein shown and described, the undesirable banding effect is essentially eliminated. For those rolling shutter assemblies where the storage roller is housed in the building wall, the slats would be oppositely curved and the outside wall of each slat would be provided with a full height, unbroken curved convex surface.

In FIGS. 2 and 3, the bottom slat B of the rolling shutter 20 can be seen to have a main body portion 68 of generally rectangular cross-section. Depending from the lower wall 69 of the body portion 68 are a pair of transversely spaced flanges 70 and 71 to which a gasket or sealing member (not shown) may be attached for effecting sealed engagement with the sill 27 (FIG. 1). At the upper end of the body portion there are provided a pair of transversely spaced, slightly outwardly angled flanges 72 and 73 configured to form a channel 74 substantially similar to the upper channel 33 in the slat 21. At the upper edge of the outer flange 72 there is provided a locking member 75 and the bottom slat B is articulately connected to the upwardly adjacent slat 21 by a connecting link 22 in a manner similar to that above described in connection with the interconnection of two relatively adjacent slats 21.

Figure 7:
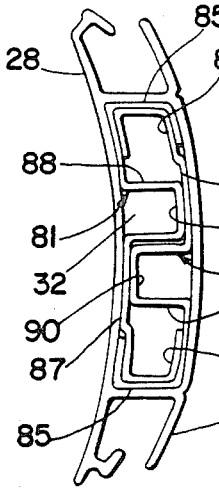
FIG. 7 is a vertical section through a shutter slat having installed therein telescoping reinforcing members according to the invention.
Figure 8:
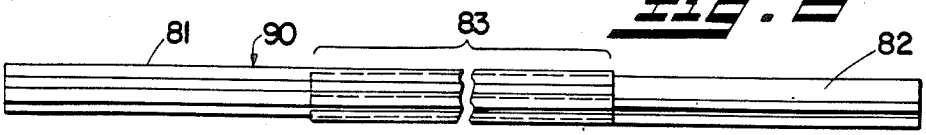
FIG. 8 is a front elevational view of the telescoping reinforcing members.

Referring now to FIGS. 7 and 8, each slat 21 may be provided with a reinforcement for rigidifying a slat 21. The reinforcement, indicated generally at 80, comprises a pair of profiled, telescoping sections 81 and 82 which may be inserted end-wise into the closed central channel 32 of the slat preferably with a close friction fit.

The telescoping sections 81 and 82 enable easy length adjustment of the reinforcement 80. During installation of the rolling shutter, the slats may have to be cut to fit a particular size of window opening. With prior art single piece metal reinforcement members, such would have to be cut to the same shorter length of the slats as by sawing with a hacksaw. This of course was a relatively difficult and time consuming task and also required the installer to have available a hacksaw or other suitable cutting tool. Considering that the rolling shutter may consist of forty or fifty slats, for example, the task of cutting the reinforcement for each slat to length could lengthen the installation process by several hours. On the other hand, with the herein disclosed reinforcement 80, the adjustment to a window fitted slat length may be quickly and easily accomplished.

As best seen in FIG. 8, the telescoping sections 81 and 82, while providing for length adjustment, are desirably substantially overlapped at 83 to provide for increased flexural rigidity at the middle region of the slat 21. The overlapping portions of the telescoping sections provide a double thickness reinforcement against bending moments at the middle region of the slat where such bending moments are usually the greatest. On the other hand, the outer non-overlapped portions of the sections provide for single thickness reinforcement at the outer regions of the slats sufficient to resist the usually lesser bending moments occurring at such outer regions while minimizing the overall weight of the slat for a given strength requirement. Preferably the telescoping sections overlap by an amount at least $\frac{1}{2}$ and preferably at least $\frac{2}{3}$ the length of the slat in which they are fitted.

When used with a plastic shutter slat 21, the telescoping sections 81 and 82 preferably are made of a material more rigid than the plastic material of the slats. Preferably the telescoping sections are made of metal such as galvanized steel. The telescoping sections have essentially identical cross-sections but one is inverted relative to the other to permit telescoping interconnection of the two sections. Although essentially identical, the sections 81 and 82 do differ slightly in cross-section in that such sections are slightly oppositely bowed to fit within the curved opening 32 of the slat 21 when relatively inverted and telescoped together, as seen in FIG. 7. However, sections of identical cross-section may be used to fit a rectangular opening such as that of the bottommost slat B. The telescoping sections may be roll formed from sheet metal and if of identical cross-section, only the set of rolling dies would be needed.

As seen in FIG. 7, each section 81, 82 has opposite edge channel portions 85 and 86 generally in the shape of a C which are integrally joined by a vertical wall portion 87 bent intermediate its length to form a U-shape rib channel portion 88. One C-shape edge channel 85 is sized to fit closely against the walls bounding the upper portion of the central slat channel 32 whereas the other channel portion 86 has a smaller size which fits closely within the larger channel portion 85 of the other reinforcing section. In this manner, the larger edge channel portions 85 are frictionally fitted in the upper and lower portions of the slat channel 32 and the smaller edge channel portions 86 are frictionally fitted in the larger channel portions at the overlapped region of the telescoping sections to strengthen and resist bending of the slats over the full length of the slats with greater reinforcement being provided at the overlapped region of the reinforcing sections.

Further rigidity of the slat 21 is obtained by the intermediate U-shape rib channel portions 88. The rib channel portions 88 are vertically offset from one another and the base wall 90 of the rib channel portion of each section is frictionally fitted against the vertical wall portion 87 of the other telescoping section which frictionally fits against the inside wall 29 or outside wall 28 of the slat.

Of course, the section profile illustrated in FIG. 7 permits telescoping joinder of the reinforcing sections 81 and 82. Neither section fits completely within the other section; rather, each section has a part thereof fitted within a mating part of the other section. Also, each section has five tranverse walls extending substantially between the outside and inside walls which contribute significantly to the overall bending strength of the sections.

Figure 9:
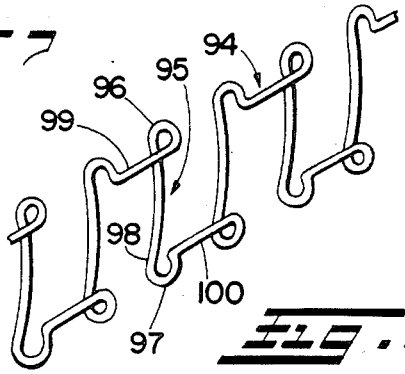
FIG. 9 is another form of link which may be used to interconnect adjacent slats.

Turning now to FIG. 9, another form of connecting link is indicated generally at 94. The connecting link 94 is formed from a continuous piece of stiff wire, such as coat hanger wire, which is bent as illustrated. More particularly, the connecting link 94 is formed with a plurality of horizontally spaced apart vertical linking portions 95. When viewed endwise, the vertical linking portions 95 each has a profile identical to the cross-sectional shape of the connecting link 22 seen in FIG. 2. Accordingly, each vertical linking portion has upper and lower hook portions 96 and 97 joined by a slightly bowed central portion 98.

Adjacent linking portions 95 are integrally joined together by upper and lower connecting portions 99 and 100 which extend horizontally between the ends of the hook portions 96 and 97 of the linking portions, respectively. As shown, the connecting portions 99 alternate top and bottom from linking portion to linking portion.

As should be apparent, the connecting link 94 may be simply substituted for the connecting link 22. When in use, the connecting link 94 provides for substantial light and also substantial air passage through the gap between spaced apart adjacent slats.

Although the invention has been shown and described with respect to a preferred embodiment, it is obvious that equivalent alterations and modifications will occur to other skilled in the art upon the reading and understanding of the specification. The present invention includes all such equivalent alterations and modifications, and is limited only by the scope of the following claims.

What is claimed is:

1. A rolling shutter comprising an array of edge-adjacent parallel shutter slats each formed at each edge with an edge channel, and a plurality of connecting links articulately interconnecting respective pairs of adjacent shutter slats, each link having opposite edge portions respectively retained in adjacent edge channels respectively of said adjacent shutter slats for pivotal movement to permit pivoting of said link relative to both said adjacent slats and for edge-wise telescoping movement to permit relative movement of said adjacent slats between spaced apart and juxtaposed positions, and each link being formed from bent wire.

2. A rolling shutter as set forth in claim 1, wherein said connecting links extend substantially the full width of said shutter.

3. A rolling shutter as set forth in claim 1, wherein said connectng links are substantially hidden from view when said slats are in such juxtaposed positions.

4. A rolling shutter as set forth in claim 1, wherein said opposite edge portions are in the shape of hooks, and each slat includes at each edge a locking member for engaging with a respective hook shape edge portion of an adjacent connecting link.

5. A rolling shutter as set forth in claim 4, wherein said locking members of adjacent slats abut each other to form a mated seam between the slats when the slats move into their juxtaposed positions.

6. In a rolling shutter, a slat comprising a hollow slat body including at least one channel extending along the length thereof, and a pair of telescopically connected reinforcing members received in and extending substantially the length of said channel, said reinforcing members being relatively movable telescopically for length adjustment.

7. A rolling shutter slat as set forth in claim 6, wherein said reinforcing members each has a part thereof fitted within a mating part of the other member.

8. A rolling shutter slat as set forth in claim 7, wherein said reinforcing members are similar in cross-section but inverted with respect to one another.

9. A rolling shutter slat as set forth in claim 6, wherein said reinforcing members each include five transverse walls extending substantially between opposite side walls of said slat body.

10. A rolling shutter slat as set forth in claim 9, wherein each reinforcing member has a part thereof fitted within a mating part of the other reinforcing member.

11. A rolling shutter as set forth in claim 6, wherein each reinforcing member has spaced inwardly from top and bottom edges thereof a U-shape rib channel portion vertically offset from the U-shape rib channel portion of the other reinforcing member.

12. A rolling shutter slat as set forth in claim 11, wherein said rib channel portion of each reinforcing member has a base wall frictionally fitted against an outer wall portion of the other reinforcing member which outer wall portion frictionally fits against a side wall of the slat body.

13. A rolling shutter slat as set forth in claim 6, wherein said reinforcing members are of approximately equal length and overlap at the middle region of said slat body.

14. A rolling shutter slat as set forth in claim 6, in combination with at least one other said shutter slat and connecting means for articulately interconnecting the slat bodies of said shutter slats while permitting relative edge-wise movement of said slat bodies between juxtaposed positions and spaced-apart positions.

15. A combination as set forth in claim 14, wherein said connecting means includes a connecting link and said connecting link is telescopically movable in said slat bodies to permit relative edge-wise movement of said slat bodies between such juxtaposed and spaced-apart positions.

16. A combination as set forth in claim 15, wherein said slat bodies when spaced apart form a gap therebetween which exposes a portion of said connecting link, and said portion of said connecting link is made of a transluscent material permitting passage of light through said gap.

17. A rolling shutter slat as set forth in claim 6, wherein each said reinforcing member has opposite edge channel portions generally in the shape of a C and integrally joined by a vertical wall portion of the reinforcing member, said opposite edge channel portions of each said reinforcing member including a larger edge channel portion sized to fit closely against edge and side walls of said slat body and a smaller edge channel portion sized to fit closely within the larger edge channel portion of the other reinforcing member.

18. A rolling shutter slat as set forth in claim 17, wherein the vertical wall portion of at least one of said reinforcing members is bent to form a generally U-shaped rib channel portion extending longitudinally of the reinforcing member.

19. A rolling shutter slat as set forth in claim 17, wherein each said reinforcing member has the vertical wall portion thereof bent to form a generally U-shaped rib channel portion extending longitudinally of the reinforcing member.

20. A rolling shutter slat as set forth in claim 19, wherein the rib channel portion of each said reinforcing member is transversely offset from the rib channel portion of the other reinforcing member.

21. A rolling shutter slat as set forth in claim 17, wherein said channel is of generally rectangular cross-sectional shape.

22. A rolling shutter slat as set forth in claim 6, wherein said slat body is made of plastic and said reinforcing members are made of metal.

23. A rolling shutter slat as set forth in claim 6, wherein each reinforcing member has a fit within said channel essentially equal the fit of the other.

* * * * *